United States Patent [19]

Ehrenfeld, Jr.

[11] 4,443,505

[45] Apr. 17, 1984

[54] EMBOSSING PILE FABRICS AND EMBOSSED LOOP PILE FABRIC

[75] Inventor: Frank E. Ehrenfeld, Jr., Morrisville, Pa.

[73] Assignee: Congoleum Corporation, Kearny, N.J.

[21] Appl. No.: 428,375

[22] Filed: Sep. 29, 1982

Related U.S. Application Data

[63] Continuation-in-part of Ser. No. 367,211, Apr. 9, 1982, and a continuation of Ser. No. 150,575, May 16, 1980, which is a continuation of Ser. No. 806,787, Jun. 15, 1977, abandoned, which is a continuation of Ser. No. 632,446, Nov. 17, 1975, abandoned, which is a continuation of Ser. No. 437,782, Jan. 30, 1974, abandoned, which is a continuation-in-part of Ser. No. 267,227, Jun. 28, 1972, abandoned, which is a continuation of Ser. No. 64,475, Aug. 17, 1970, abandoned, said Ser. No. 367,211, is a continuation of Ser. No. 15,297, Feb. 26, 1979, Pat. No. 4,340,381, which is a continuation-in-part of Ser. No. 616,307, Sep. 24, 1975, abandoned, which is a continuation of Ser. No. 492,011, Jul. 26, 1974, abandoned, which is a continuation of Ser. No. 267,227.

[51] Int. Cl.[3] ..... B32B 3/02

[52] U.S. Cl. ..... 428/89; 8/115.5; 8/929; 427/258; 427/264; 427/270; 427/275; 427/288; 428/92

[58] Field of Search ..... 428/89, 92; 8/115.5, 8/929; 427/258, 264, 270, 275, 288

[56] References Cited

U.S. PATENT DOCUMENTS 3,849,157 11/1974 Palmer ..... 428/89

*Primary Examiner*—Marion McCamish

*Attorney, Agent, or Firm*—Richard T. Laughlin; Robert C. Beam; Daniel J. Reardon

[57] ABSTRACT

A process for developing an embossed effect on nylon pile fabric by applying the embossing agent and color to the pile, using a wet-on-wet technique to move the embossing agent toward the base of the pile, and finishing by heating the treated pile. An embossing of satisfactory depth is obtained, shrinkage of the fibers is near the base, with the embossed fibers at their exposed ends having a soft feel. Dye penetration in the fiber is commercially acceptable.

10 Claims, 3 Drawing Figures

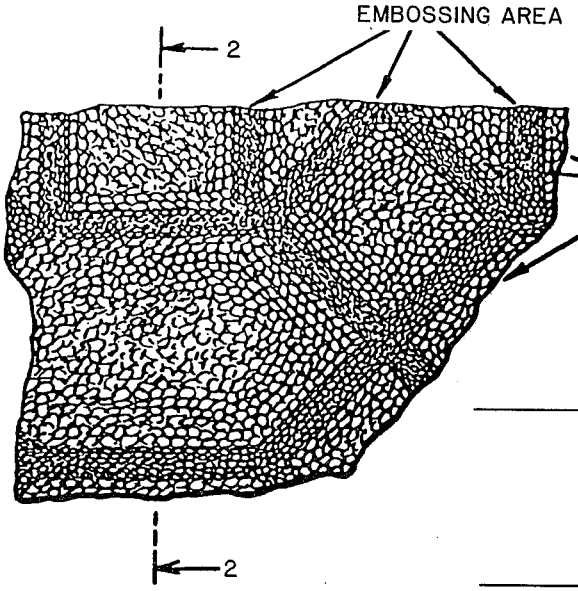
FIG. 1
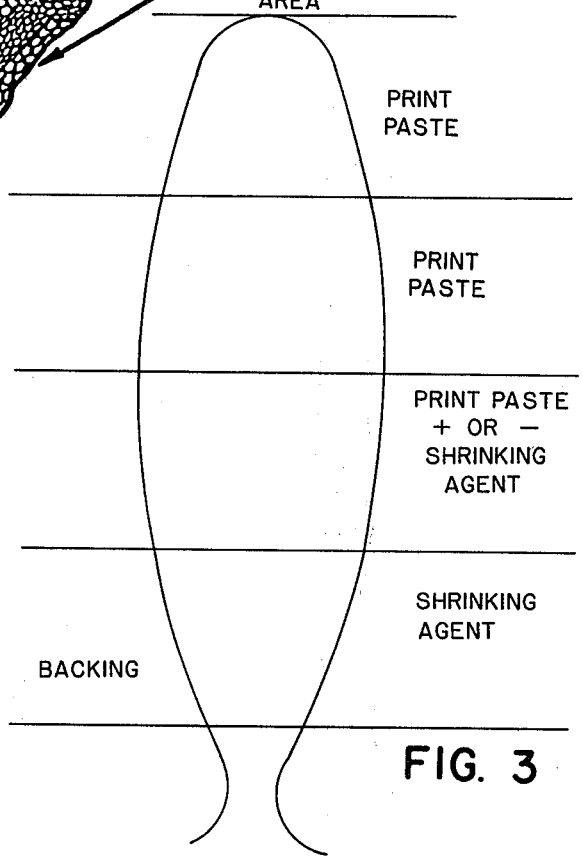
FIG. 3
FIG. 2
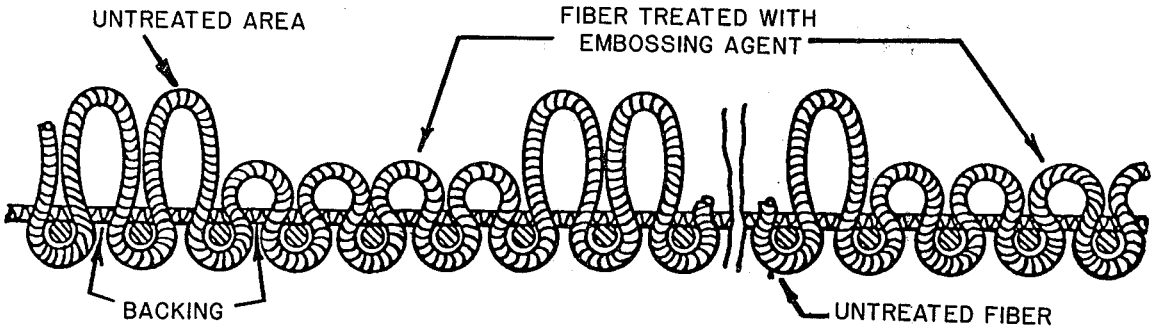

EMBOSSING PILE FABRICS AND EMBOSSED LOOP PILE FABRIC

This is a continuation of application Ser. No. 150,575 filed May 16, 1980; which is a continuation of application Ser. No. 806,787 filed June 15, 1977 (now abandoned), which is in turn, a continuation of application Ser. No. 632,446 filed Nov. 17, 1975 (now abandoned); and the latter a continuation of application Ser. No. 437,782 filed Jan. 30, 1974 (now abandoned).

This latter application is a continuation-in-part application of application Ser. No. 267,227 filed June 28, 1972 (now abandoned); which is, in turn, a continuation application of application Ser. No. 64,475 filed Aug. 17, 1970 (now abandoned).

This application is, in addition, a continuation-in-part application of application Ser. No. 367,211 filed Apr. 9, 1982; which is a continuation of application Ser. No. 15,297 filed Feb. 26, 1979, (issued as U.S. Pat. No. 4,340,381); which is a continuation-in-part of copending application Ser. No. 616,307 filed Sept. 24, 1975 now abandoned; which is a continuation of application Ser. No. 492,011 filed July 26, 1974 (now abandoned); which is, in turn, a continuation of foregoing application Ser. No. 267,227 filed June 28, 1972 (now abandoned); which is a continuation of application Ser. No. 64,475 filed Aug. 17, 1970 (abandoned) also recited hereinabove.

BACKGROUND OF THE INVENTION

In the production of nylon pile fibers, it is often desirable to emboss the surface thereof in order to provide extra decorative appeal. Im some instances, the embossed areas are printed with dyes to embellish the surface design and to develop multi-colored embossed patterns.

Embossing of pile fabrics is conventionally accomplished with a heat embossing roll or plate which has been engraved or otherwise treated to create the design desired in raised relief on the surface. A method which eliminates the use of embossing rolls has been disclosed in U.S. Pat. Nos. 2,790,255 and 2,875,504. In accordance with these patents, pile fabric is formed from a combination of (shrinkable and non-shrinkable) yarns. Upon subjecting the fabric to the influence of heat, the pile formed from the shrinkable yarns contracts while the base and the non-shrinkable yarns remain intact thereby yielding a pile made up of high and low areas to give the appearance of an embossed or carved product.

A chemical embossing method is disclosed in U.S. Pat. No. 2,020,698. According to this patent, fabric having a pile of organic ester or cellulose yarn is locally treated with an alkali or alkaline salt saponifying agent in order to obtain ornamental differential effects in the treated areas. Furthermore, since the organic ester of cellulose pile yarns that have not been saponified are more difficult to change from their position, after they are once set than are the saponified organic ester of cellulose yarns, it is possible to obtain a differential lay between the saponified and unsaponified organic ester of cellulose pile yarn. Thus, the fabric, after the application of the saponifying agent, may be washed, finished and dried with the pile erect, after which the fabric may be run through water and brushed across the piece to lay the pile towards the selvage and it is then dried. This causes the saponified pile yarn to lie flat while the unsaponified yarn remains substantially erect. Upon subsequent steaming and brushing the fabric in the opposite direction, any unsaponified yarn which may have been slightly bent from the vertical by the previous brushing toward the selvage is caused to stand erect without disturbing the position of the laid or crushed saponified organic ester of cellulose pile yarn.

SUMMARY OF THE INVENTION

It is a primary object of this invention to provide a process for embossing the surface of a nylon pile fabric to a significant depth using a wet-on-wet printing technique to induce shrinkage of the fiber near its base and to retain its soft surface texture.

Another object is to provide such a process which is readily adaptable to standard screen printing equipment, i.e., flat bed or rotary screen printing equipment used in the carpet industry.

Another object is to provide a process which allows the production of pile fabric having embossed areas where desired in register with a printed design, so that designers have great latitude in setting out combinations of colors and embossing.

Still further objects and advantages of this invention will be apparent from the following description.

It has now been found that it is possible to produce superior nylon pile fabrics having a soft feel and embossed surfaces by contacting selected portions of the surface with a chemical embossing agent for the fibers of the pile fabric, moving it toward the base of the pile fibers and causing dimensional change by linear contraction of the treated fibers and, thereafter, effectively removing the embossing agent. The resulting product is thus depressed or recessed in those areas that were contracted by the chemical embossing agent to a significant and definable extent. The nylon fabrics can be any pile fabric such as plush or carpeting of any construction, e.g. level-loop, multi-level-loop, cut-loop, plus, or other forms.

The embossing composition can be undyed or unpigmented so that its effect on the pile fabric is essentially in embossing it. Alternatively, the embossing agent can be a part of the dye or pigment composition used in printing the fabric so that the color appears in perfect register in the areas of embossing agent application.

The pile fabric treated with the embossing agent is treated with heat or steam for a period of time to expedite the linear dimensional change of the fiber and then washed and dried in conventional manner. The steam treatment also serves to fix the dye on the fibers.

The extent of the embossing will vary, normally, with the relative concentration of embossing agent in the embossing composition as well as the total amount applied to the fabric and the extent to which the fabric is subsequently treated. Thus, proper control of these variables, among others, permits embossing to any desired depth or width.

This discovery makes possible the production of a product having enhanced embossed surfaces utilizing appropriate concentrations of embossing agents which can be in complete register with a printed design. The discovery makes possible also the utilization of screen type printing apparatus which may be employed for purposes of effecting embossing. Further, it allows the embossing of a surface without exerting such pressure that it permanently deforms the pile fabric. A great number of products can be produced by the process. They can be used for floor, wall and ceiling coverings, drapery, upholstery and the like, and, in fact, wherever pile fabrics are utilized. They are readily adaptable to decorating any surface on which pile fabric can be applied.

This invention will be better understood from the following detailed description thereof together with the accompanying self-explanatory drawings in which:

FIG. 1 is enlarged top view of a section of an embossed product of this invention; and, FIG. 2 is an enlarged cross-sectional view of the closed loop pile fabric of the product shown in FIG. 1 taken through the line 2—2.

FIG. 3 is an enlarged cross-section showing a loop of pile and indicating diagrammatically the means of shrinking the fiber near its base.

Wile FIG. 2 represents a closed loop pile fabric, an open loop structure is equally suitable.

DESCRIPTION OF THE PREFERRED EMBODIMENTS

In the production of the pile fabrics of this invention the pile yarn employed is nylon generally denominated Nylon 6, or Nylon 6,6. Synthetic fibers prepared from polyamides, or nylons, are well known to those skilled in the art and as these terms are employed herein are intended to include any long chain synthetic polymeric amide which has recurring amide groups as an integral part of the main polymer chain and which is capable of being formed into a filament in which the structural elements are oriented in the direction of the axis of that chain.

Polyamide resins within this definition and contemplated in the practice of the present invention are formed generally by reaction of a dicarboxylic acid with a diamine or by the self-condensation of an aminocarboxylic acid. Illustrative of these polyamide resins are nylon-6,6, prepared by the condensation of hexamethylenediamine and adipic acid; nylon-6,10, prepared from hexamethylenediamine and sebacic acid, both of the foregoing having, as prepared molecular weights of approximately 20,000 to 50,000 or more, nylon-6 produced by thermal polymerization of epsilon-amino-caproic acid or caprolactam; nylon-11, the self-condensation product of 11-aminoundecanoic acid; as well as a variety of polymers prepared from polymerized, unsaturated fatty acids and polyamino compounds.

The practice of the present invention has, however, particular application to the solid, melt-extrudable and orientable fiber-forming polyamides and more particularly to fibers and filaments prepared therefrom which have a denier and tenacity appropriate, and well known to those skilled in the art, for use in carpet, rugs, tapestry and the like. Illustrative of these polyamides are those having a filament denier of 1 to 630 or higher or nylon yarns in the denier range of 20 to 210. The tenacities of nylon yarn for use herein are within the range of 4.5 to 8 grams per denier. The elongation of drawn yarns can vary from 12 percent to about 100 percent or 200 percent and, depending on the application, undrawn yarn is capable of being elongated up to 400 percent to 500 percent or more. It is understood additionally that encompassed within the polyamides that can be employed in the practice of this invention are high molecular weight synthetic linear polyamides, in addition to those described hereinabove, that have been modified, for example, to enhance their usefulness for particular applications. Illustrative of the foregoing are the polyamides described in U.S. Pat. Nos. 3,184,436 and 3,560,448 where the dyeability of the polymers is enhanced, for example, by the inclusion of sulfonic acid moieties in the polymer molecule.

An extended discussion of polyamides of sufficiently high molecular weight to be capable of being melt spun into filaments and coming within the contemplation of this invention appears in D. E. Floyd, *Polyamide Resins*, Reinhold Plastics Application Series (2nd Printing 1961), and H. R. Mauersberger, *Mathews' Textile Chemical Properties* (6th ed. 1954).

The embossing agent preferred and used in this invention is monochloroacetic acid. In this application, the term "embossing composition" embraces any color-free or color-containing composition containing a sufficient amount of monochloroacetic acid therein so that when it is applied to a pile fabric and then treated by the process of this invention a significant and noticeable embossing effect is obtained. By applying the embossing composition to a given area of carpet and then applying over it a color, or the composition, the embossing agent is displaced toward the base of the fiber, as illustrated in FIG. 3, and shrinkage occurs in the mid-or lower section of the fiber. The outermost end of the fiber retains its original soft texture.

The concentration of embossing agent, or monochloroacetic acid, in the embossing composition can vary from about 35 weight percent to about 65 weight percent; preferably from about 55 weight percent to about 60 weight percent.

The embossing compositions used in accordance with the process of this invention can be used in conventional equipment using wet-on-wet technique of this invention. In the wet-on-wet technique the carpet is not dried between applications of the embossing composition and the dye paste composition; this was found to produce a product having satisfactory embossing depth with the embossed fibers having a softer feel than normally obtained. The process can also be used employing the negative trap technique, in which the embossing composition is applied to the dry pile fabric or carpet in paste-defined areas and it is not diluted with standard dye pastes during the printing operation. In the wet-on-wet process, preferred method, embossing is obtained by printing with the embossing composition, first, and then overprinting with one or more standard dye paste compositions. The embossing composition is thus displaced to a mid-level or to the bottom of the fibers. Printing with the embossing composition first is generally preferred as embossing depth is deeper than printing with the embossing paste last. The softer feel of the embossed fibers and the depths acheived were completely unexpected.

The depth of penetration by the embossing composition is of importance since this affects the extent to which a particular composition will shrink or emboss the pile fabric fibers. In practice it is desirable that the embossing agent contact as much of the length of the fibers forming the pile as possible, and in such manner as to enable the embossing operation to be completed as quickly as possible consistent with conventional printing techniques.

In order to be applicable for the novel process of this invention, the embossing composition should provide a reduction of the pile height through a shrinkage reaction, should not adversely affect the printing means, e.g. print screens, and should be capable of being substantially removed or inactivated subsequent to the embossing action. Other characteristics of the embossing composition which are desirable, though not essential, include compatibility with dye print pastes, capability of being regulated by factors of time, temperature, and concentration, i.e. susceptibility to activation by a conventional steaming operation and exhibiting no residual embossing activity. Needless to say minor adjustments in the nature of the components and process conditions, and/or the embossing apparatus can be employed to overcome the absence of certain of these desired characteristics.

The embossing composition for use on the fibers of nylon pile fabric is applied to the ends of the pile fibers remote from the base to which they are secured in any desired design, whether it be random or predetermined. One of the easiest methods of applying the embossing composition is by utilizing conventional printing techniques, such as silk screen. The embossing agent is applied as a concentrate, as part of a transparent vehicle, or as part of a dye composition utilized for pile fabric printing. Among such applicable vehicles are included: water, alcohols such as methanol and isopropanol. Often thickeners, e.g. gums, and cellulose derivatives, are included in order to obtain viscosity characteristics demanded in print technology and to enable the embossing agent to adhere to and operate on the synthetic fiber and to hold the printed pattern.

In those instances where it is desired to achieve a single—or multi-colored printed decoration with a distinct color for the embossed areas, the embossing agent can be incorporated into a particular dye or pigment composition. The dye or pigment will be generally in the form of a print paste ink to which the appropriate amount of agent is added. It is to be noted that in preparing these modified dye compositions the pH levels, viscosities, and dye concentrations which are essential to an efficient dyeing operation must also be controlled. The resultant effect is an embossed design in register with the printed pattern.

The embossing agent is normally in solution when applied to the selected areas of the fabric. All of the embossing composition components need not be in solution. However, they should be in the embossing composition in a form at least sufficiently finely divided to pass through the print screen, that is, they should be present in a micro pulverized form which indicates particle diameter of the order of 100 microns or smaller. That is, they must not only pass through a screen but must pass through freely, dispersed through the dye paste throughout the printing operation. The purpose of this, of course, is to make sure that the agent becomes uniformly dispersed over the fiber in the print process so that the shrinking effect will be uniformly developed in the fiber.

After application of the embossing composition to the pile fabric, embossing is achieved by heating at an elevated temperature. The treated pile fabric is heated at a temperature of from about 200° F. to 250° F. by subjecting it to heat from any of a variety of sources, such as, infra red radiation, heated drum or coil, or, most desirably and effectively, by steam. The duration of exposure to elevated temperatures can vary from about five to about thirty minutes or more, preferably from about ten to about fifteen minutes.

In FIG. 3 we have illustrated diagrammatically the wet-on-wet printing—embossing technique. The embossing composition is laid on, over it, in one, two, or three overprints are color pastes; the top or outermost layer well contain no embossing agent; after steam treatment, and shrinkage in the mid and lower section of the fiber, the outer ends of the fiber are soft and unaffected.

The degree of dimunition of the height of the pile, or embossing effect, is influenced by many factors. These include the concentration of embossing agent in the embossing composition, the amount of embossing composition employed, the temperature and time at which embossing is effected, as well as the physical and chemical parameters of the particular pile fibers employed and even the concentration of fibers in the pile.

While the depth of embossing will be determined by the practitioner in accordance with the type of embossed product being prepared, reduction in pile height will generally not exceed more than about 50%, this value being indicative of excellent embossing without exposing the backing materials.

A critical step of the novel process of this invention involves terminating the embossing action and/or effecting substantial removal of the embossing agent as residual penetrant from the pile fabric. It may be necessary to achieve complete elimination of all residues of the embossing process which may contribute undesirable properties to the finished fabric, such as odor, toxicity and color and texture change. Needless to say, any termination or quenching technique resorted to will depend on the particular embossing composition employed. The most useful technique for removing residues of the embossing process is by thoroughly washing the fabric with water and detergents. In those instances where the embossing agent is part of a dye or pigment composition, the washing cycle which is utilized to remove excess dye or pigment serves also to remove traces of the agent.

Other techniques for terminating the embossing action and/or removing the embossing agent inclue evaporation and dry cleaning. Thus, if the agent is volatile, steaming of the treated pile fabric will serve to evaporate a large portion of the embossing pile content. Where rinsing techniques are not effective, it may be necessary to a dry cleaning procedure to remove the embossing residues.

The invention has particular application to tufted carpets which are to have a printed decoration applied thereon. Unusual design effects can also be obtained when the pile fabric is printed with a multi-colored design wherein one or more of the dye compositions contain the appropriate embossing agent. The process of printing such carpets includes the steps of passing carpets, tufted or unpigmented or colored fibers, into a screen printing apparatus whereby a design is printed on the surface of the carpet. Each screen applies a separate color to make up the final design. The embossing agent can be added to one or more of these printing stations by addition of the dye composition, or it can be applied by a separate station in a transparent vehicle. The fabric is then passed into a steaming chamber to set the dyes and cause embossing and then to a washing cycle which serves to remove excess dye as well as to terminate the embossing action and remove the embossing components. Note FIG. 3.

Accordingly, in the embossing of carpet or textured pile fabric, and for all practical purposes we are discussing the embossing of carpeting, it is important that any color design on the surface of the carpet which is related to the embossing be in accurate register with the embossing. Since we are concerned only with chemical embossing the problem is then one of inducing the differential fiber length between the embossed colored areas and unembossed areas and, while it is possible to induce shrinkage of synthetic nylon fibers, it is necessary for preparation of the carpet that the fiber shrinkage be induced with no significant deterioration of what is left. Thus, if the operation of embossing involves true shrinkage the shrunk fabric fiber should have a texture approximating that of the original.

In order to determine the parameters to be employed with a particular embossing composition and a specific nylon pile, the chemical system is incorporated in a dye printing paste and applied to a section of the nylon carpet by means of a screen printing technique so as to simulate plant production procedure as closely as possible. The treated carpet sample is steamed for 15 minutes at 215°-300° F. (102° C.-150° C.), thoroughly rinsed with water and dried at 180° F.-(82° C.). The depth of embossment is then measured and observations made regarding the character of the embossed nylon, e.g. strength, brittleness, softness, definition, color. Measurement of the pile height at the embossed and unembossed areas is made by means of a thin, steel ruler market off in 1/64 inch (0.4 millimeter) intervals. Any method of measurement is useful so long as it is standardized from operation to operation and is reproducible to about 1/64 inch.

The following examples further serve to illustrate the invention. In these examples, as well as in the remainder of the specification all references to "parts" or "percentages" (%) are references to parts or percentages by weight unless otherwise expressly indicated.

EXAMPLE I

This example illustrates the practice of the invention employing variations in the mode of application and the carpet treated.

A dye embossing composition of the following components was prepared:

| Component | Amount (grams) |
|---|---|
| Intra AS | 5 |
| Anti 73 | 5 |
| Poly 260 Solution | 120 |
| Water | 270 |
| Monochloracetic acid | 600 |
| Black BGL | 0.5 |

The composition had a pH of 1.0 and a specific viscosity of 525 centipoises.

Four standard dye paste compositions (1,2,3 and 4) were also prepared having the following compositions and properties:

| | Amounts | | | |
|---|---|---|---|---|
| Components | 1 | 2 | 3 | 4 |
| Formic acid | 40 | 40 | 40 | 40 |
| Intra AS | 5 | 5 | 5 | 5 |
| Anti 73 | 5 | 5 | 5 | 5 |
| Poly 260 Solv | 300 | 300 | 300 | 120 |
| Water | 650 | 650 | 650 | 650 |
| Blue 3G | 0.5 | | | |
| Yellow 4GL | 2.0 | 2.5 | | |
| Red FL | | 0.5 | 0.44 | 1.4 |
| Black BGL | | 1.0 | | |
| Yellow NW | | | 1.5 | |
| Red 3BL | | | | 0.9 |
| Spec Visc, cps at 80° F.* | 600 | 600 | 620 | 620 |
| ph | 2.2 | 2.1 | 2.1 | 2.2 |

*Specific viscosity, centipoises at 80° Fahrenheit.

(A) A 36 ounce, heat-set, unbacked, cut pile nylon carpet was printed with the above embossing composition using a flat bed silk screen, with the mortarline printed first. This, the mortar line, was then overprinted with the four different standard dye pastes (1,2,3,4) to achieve a multi-colored pattern design. Printing was done using four strokes and large squeegee rollers. The carpet was steamed for 22 minutes at 230° F., washed and dried at 200° F. for 15 minutes. An attractive, good embossing depth was obtained and the fibers in the embossed areas were soft. That is, shrinkage had selectively taken place in the lower part of the fiber.

(B) The same procedure on a 20 ounce velvet type nylon carpet also produced an attractive carpet having good embossing depth with soft embossed fibers.

(C) Using the same procedure but only two strokes and steaming for 12 minutes, good embossing depth and soft embossed fibers were obtained on a 13 ounce level-loop backed nylon carpet.

(D) Following the procedure of Example I(A) but applying the mortarline last, the cut pile fabric showed good embossing depth with the embossed fibers slightly less soft.

(E) Following the procedure of Example I(B) but applying the mortarline last, the velvet fabric showed a slightly lesser embossing depth with soft embossed fibers.

(F) Following the procedure of Example I(C) but applying the mortarline last, the cut pile fabric showed a shallower embossing depth and soft embossed fibers.

EXAMPLE II

This example illustrates further the application of the embossing compositions of the invention.

An embossing composition was produced as described in Example I having a specific viscosity of 625 centipoises. Four different colored standard dye pastes were also prepared as described in Example I; these compositions had specific viscosities of 625, 600, 620, and 625, respectively.

(A) A 40 ounce, singles, unbacked nylon carpet was embossed, printed, steamed, washed and dried as described in Example I(A). The carpet showed a good embossing depth with soft embossed fibers.

(B) A 20 ounce, level loop, backed nylon carpet was embossed, printed, steamed and dried as described in Example I(C). The carpet had good embossing depth and soft embossed fibers.

(C) An unbacked nylon carpet was embossed, printed, steamed and dried as described in Example I(A). The carpet had excellent embossing depth with soft embossed fibers.

EXAMPLE III

This example further illustrates the use of embossing compositions within the purview of the invention having a variable viscosity.

An embossing composition was prepared as described in Example I but containing 25 weight percent of the Poly 260 Solution; it had a specific viscosity of 2,500 centipoises. Four standard dye paste solutions were prepared, also as described in Example I having specific viscosities of 625, 650, 900 and 700 centipoises, respectively.

(A) A 36 ounce heat-set nylon carpet was embossed, printed and steamed as described in Example I(A) washed, and then dried for 30 minutes at 200° F. The carpet showed fair embossing depth, soft embossed fibers and dye penetration of 80 to 100 percent.

(B) A 20 ounce level loop nylon carpet was embossed, printed, steamed and dried as described in Example I(B). The carpet showed good embossing depth, soft embossed fibers and penetration ranging from 50 to 75 percent of the pile depth.

(C) A 20 ounce velvet cloud nylon carpet was embossed, printed, steamed and dried as described in Example I(A) above. The carpet had good embossing depth, soft embossed fibers and penetration ranging from 75 to 90 percent.

EXAMPLE IV

This example illustrates the application of the invention to a foam backed carpet.

An embossing composition of the following components was prepared:

| Component | Amount (grams) |
|---|---|
| Intra AS | 10 |
| Anti 73 | 5 |
| Poly 260 Solution | 140 |
| Water | 345 |
| Monochloracetic acid | 600 |
| Black BGL | 1 |

The composition had a pH of 1 and a specific viscosity of 600 centipoises.

Four standard dye paste compotions (1,2,2 and 4 below) were prepared having the following compositions and properties:

| | Amounts (grams) | | | |
|---|---|---|---|---|
| Components | 1 | 2 | 3 | 4 |
| Formic acid | 30 | 30 | 30 | 30 |
| Intra AS | 10 | 10 | 10 | 10 |
| Anti 73 | 5 | 5 | 5 | 5 |
| Poly 260 Solv | 300 | 300 | 300 | 300 |
| Isopropanol | 40 | 40 | 40 | 40 |
| Alkanol CN | 5 | 5 | 5 | 5 |
| Water | 615 | 615 | 615 | 615 |
| Blue 3G | 0.5 | | | |
| Yellow 4GL | 2.0 | 2.5 | | |
| Red FL | | 0.5 | 0.44 | 1.4 |
| Black BGL | | 1.0 | | |
| Yellow NW | | | 1.5 | |
| Red 3BL | | | | 0.9 |
| Spec. Visc. cps at 80° F. | 675 | 675 | 650 | 650 |
| pH | 2 | 2 | 2 | 2 |

A 20 ounce Cadon, foamed backed nylon carpet of 3,690 denier, 3 ply, 1/10 gauge 8.5 stitches per inch, ⅛ inch pile height was printed with the embossing compositions, mortarline first, and then overprinted with the four standard dye paste compositions as described in Example I. Large rollers were used; two strokes. The carpet was steamed 11 minutes at 230° F., washed, and dried at 200° F. for 20 minutes. Embossing depth was excellent and dye penetration ranged from 90 to 100 percent.

EXAMPLE V

This example illustrates the application of the invention utilizing pigmented and unpigmented embossing compositions.

Two embossing compositions were prepared, one pigmented and one clear for filigree printing. Their compositions and properties were:

| | Amounts (grams) | |
|---|---|---|
| Components | Pigmented | Clear |
| Black BGL | 2 | — |
| Intra AS | 10 | 10 |
| Anti 73 | 5 | 5 |
| Poly 260 Solution | 140 | 130 |
| Isopropanol | 40 | 40 |
| Alkanol CN | 5 | 5 |
| Monochloroacetic acid | 600 | 600 |
| Water | 200 | 210 |
| Spec. Visc. cps at 80° F. | 700 | 600 |
| pH | 0.8 | 0.8 |

(A) The carpet described in Example IV was first mortarline printed with the pigmented embossing composition and then overprinted with the four standard dye pastes of Example IV; printing was performed using 2 strokes and large rollers. The carpet was steamed at 230° F. for 11 minutes, washed, and dried at 200° F. for 20 minutes. The embossing depth was good, the embossed fibers were relatively soft, and dye penetration was 90 percent of the pile depth.

(B) The same procedure was followed as described in Example V(A). The carpet was initially mortarline printed with the pigmented embossing composition, then with the clear filigree embossing composition using a 74 mesh screen, and finally with the four standard dye paste compositions. The mortarline embossing depth was good, the filigree embossing depth was fair to good, and dye penetration was 90 percent.

(C) The same procedure was followed as described in Example V(B) except that the filigree printing was last. The same results were obtained except that the color of the embossed area under the filigree printing was lighter.

EXAMPLE VI

This example illustrates further variation in the application of the present invention.

Two embossing compositions were prepared, as described in Example V, having the following components and properties:

| | Amounts (grams) | |
|---|---|---|
| Components | Pigmented | Clear |
| Black BGL | 2 | |
| Intra AS | 5 | 5 |
| Anti 73 | 5 | 5 |
| Poly 260 Solution | 150 | 150 |
| Water | 240 | 240 |
| Monochloroacetic acid | 600 | 600 |
| Spec. Visc., cps at 80° F. | 600 | 600 |
| pH | 0.9 | 0.9 |

Four standard dye paste compositions were prepared having the following compositions (in grams), and properties:

| | Amount (grams) | | | |
|---|---|---|---|---|
| Components | 1 | 2 | 3 | 4 |
| Formic acid | 40 | 40 | 40 | 40 |
| Intra AS | 5 | 5 | 5 | 5 |
| Anti 73 | 5 | 5 | 5 | 5 |
| Poly 260 Solv | 180 | 180 | 180 | 180 |
| Water | 770 | 770 | 770 | 770 |
| Blue 3G | 0.5 | | | |
| Yellow 4GL | 2.0 | 2.5 | | |
| Red FL | | 0.5 | 0.44 | 1.4 |

-continued

| Components | Amount (grams) 1 | 2 | 3 | 4 |
|---|---|---|---|---|
| Black BGL | | 1.0 | | |
| Yellow NW | | | 1.5 | |
| Red 3BL | | | | 0.9 |
| Spec. Visc., cps at 80° F. | 700 | 700 | 700 | 750 |
| pH | 1.8 | 1.9 | 1.8 | 1.9 |

(A) A 13 ounce, level loop nylon carpet was mortarline printed with the pigmented embossing composition, then filigree printed with the clear embossing composition using a 60 mesh screen, and finally with the four standard dye paste compositions to produce an attractive pattern. The printing was done with large rollers, two strokes. The carpet was steamed at 230° F. for 11 minutes, washed and dried at 200° F. for 20 minutes. Both mortarline embossing and filigree embossing showed good depth.

(B) The procedure of Example VI(A) was repeated using a 74 mesh filigree screen. The same good embossing depths were noted.

(C) The procedure of Example VI(A) was repeated but this time the pigmented embossing paste was also used in the filigree screen printing step. The same good embossing depths were noted.

EXAMPLE VII

This example illustrates the exercise of the invention in a commercial scale operation with different size screens for application of the embossing and dye compositions to the pile fabric and the effect secured in the embossing depth as a result.

An embossing composition was prepared having the following components and properties:

| Components | Amounts |
|---|---|
| Yellow 2G | 675 grams |
| Blue 3G | 67 grams |
| Black, WAL | 232 grams |
| Water | 102 gallons |
| Monochloracetic acid | 600 pounds |
| Polygrum 260 Solution | 30 gallons |
| Anti 73 | 10 pounds |
| Ciba AS | 5 pounds |
| Spec. Visc., cps of 80° F. | 475 |
| pH | 1 |

Four standard dye paste compositions were prepared having the following components and properties:

| Components | Amounts 1 | 2 | 3 | 4 |
|---|---|---|---|---|
| Yellow 2G grams | 1440 | 1760 | 1035 | 1170 |
| Blue 3G, grams | 90 | 99 | 94 | 118 |
| Yellow NW, grams | | | 81 | |
| Yellow 4GL, grams | | 54 | | |
| Water, gallons | 22.5 | 22.5 | 22.5 | 22.5 |
| Polygum, gallons | 32 | 32 | 32 | 32 |
| Formic acid, pounds | 20 | 20 | 20 | 20 |
| Anti 73, pounds | 10 | 10 | 10 | 10 |
| Ciba AS, pounds | 5 | 5 | 5 | 5 |
| Spec. Visc., cps at 80° F. | 600 | 700 | 650 | 600 |
| pH | 2.4 | 2.3 | 2.4 | 2.4 |

(A) 40 ounce cut pile nylon carpet was mortarline printed with the embossing composition using a 60 mesh screen; the printing with the dye paste compositions being carried out with a 74 mesh land screen. Four strokes of a small squeegee roller were used. In this example commercial-size equipment was used throughout. The printed carpet was steamed at 230° F. for 12 minutes, washed and dried at 200° F. for 20 minutes. An attractive Spanish motif pattern was obtained. The embossing was 1/16 inch deep and the embossed fibers had a soft feel. A 75 feet length was produced.

(B) In one portion of the run, about 75 feet in length, the mortarline printing was carried out using a 40 mesh screen. All other conditions were as in Example VII(A). In this instance the embossing depth was 3/16 inch and the embossed fibers had a soft feel.

(C) The embossing paste was printed on the same nylon carpet using a 40 mesh first mortarline screen and then overprinted with the standard dye paste listed under the numerical designation "1" at the beginning of this Example VII, and having a specific viscosity of 600 centipoises with a second 74 mesh mortarline screen to simulate the negative trap technique as distinquished from the wet-on-wet technique employed in Example VII (A) and (B) hereof. About 60 feet of carpet length was embossed in this manner under the same conditions of Example VII (A) and (B). The embossing depth was 3/16 inch and the embossed fibers had a soft feel.

(D) The conditions of Example VII (C) were repeated substituting a 60 mesh first mortarline screen. Again a satisfactory embossing depth of 3/16 inch was obtained and the embossed fibers had a soft feel.

In recapitulation and with further reference to the drawings the significance of the mortar line and the application of the print paste over a paste containing the shrinking agent should be specifically noted. We have found that by inducing shrinkage of the fiber in embossed areas on parts of the fiber near its base or midsection, the outer extremities, which are those that are felt by the users of the carpet, retain a soft feel. Hence, for example, as shown in FIG. 1 the area designated 10 is unembossed and that designated 11 is what we call the mortar line and is embossed. Generally in the mortar lines a dark dye can be used in the paste compositions so that contrasting colors appearing in areas 10 leave a margin in application. That is the colors can overflow into the mortar line area and form one or two or more, layers, but if they are applied over a dark composition carrying a shrinking agent, or if they are deliberately made dark subsequent to the printing the color areas, areas 10 will be sharply outlined in their own colors and the mortar line will be emobssed, remaining soft at the outer extremities and, hence, the end product thus enhanced. The limitations on the designer with this technique are his own imagination.

In the past it was common to use what was called a negative trap technique in the development of colored areas ten in contrast with mortar line areas eleven. That is, it was necessary to avoid having the color in the area 10 reach the mortar line 11 with the result that very often a bi-color effect was obtained in the area. This technique has its own advantages but it has the disadvantage of having to accept an extra color rendition in a complex pattern.

Thus in applicants' invention, generally, either a clear paste or dark colored paste carrying a shrinking agent is applied on the fabric over an area corresponding to the mortar line. Subsequently one, two, three, or even four colors in additional applications of paste are made in the areas designated 10, allowing those colors to extend over onto the mortar line. Since the colors are applied in a paste, and generally quite viscous paste, as has been indicated in discussion of the examples, the effect of the successive applications of paste in the mortar line area is to force the shrinking agent down to the base of the fiber. The net result is that the shrinking induced when the carpet passes to the steaming step to set color and cause the shrinking agent to take its effect is that shrinkage occurs near the base of the fiber, or the loop, and the outer portions are colored and fundamentally unaffected by the shrinking agent, simply because there is none there.

As indicated in the examples the variations possible with having the shrinking agent applied as the bottom layer of three or four or five layers, or possibly in the bottom two or three layers of as many as five layers of paste, should be apparent to the designer. Virtually infinite combinations of color thus became possible.

Virtually any embossing agent can be used on nylon carpet provided it is effective to induce the shrinkage and for variations in the shrinking agent formulae, reference may be had to co-pending applications assigned to the instant assignee, said applications being filed by Conger and Palmer, Aug. 6, 1973 under Ser. Nos. 386,047; 386,037; 386,048. They are to be considered fully incorporated herein as illustrating alternative embossing compositions. Details of the applications may be seen in the copies thereof which are filed herewith as Appendices A, B and C.

Dyes and chemicals are commercial products. Actually as specifically indicated herein the basic composition is water, a thickening agent such as Xanthan Gum, or carboxymethyl cellulose, and the shrinking agent. The viscosity of the paste is such that it falls within the range recommended and this is merely a numerical definition of a paste which can be handled reasonably conveniently on the screen printing apparatus which is used for the purpose. The basic manipulations of the dyes, which are all conventional commercial dyes, available from various dye houses, simply require that the dye be incorporated in the paste in a finely divided form and the paste serve merely to hold it in place on the fiber while the treatment induces its fixation.

It will be evident that the terms and expressions which have been employed are used as terms of description and not of limitation. There is no intention in the use of such terms and expressions of excluding equivalents of the features shown and described or portions thereof and it is recognized that various modifications are possible within the scope of the invention claimed.

What is claimed is:

1. A process for providing an embossed effect on nylon pile fabric having a surface of upstanding nylon fibers that comprises applying to defined areas of the pile fabric an embossing composition applying over said embossing composition a composition to displace said embossing composition toward the base of said fibers allowing said embossing composition to remain in contact with said fibers for a period of time and at a temperature sufficient to reduce the height of the pile only in the areas contacted by the embossing composition, without deterioration of the fibers, said reduction being sufficient to display a significant embossed effect in the overall fabric.

2. The process of claim 1 wherein the embossing agent is applied while having on the pile fabric a wet dye paste composition.

3. The process of claim 1 wherein the embossing agent is monochloracetic acid at a concentration of about 35 to 65 weight percent.

4. The process of claim 1 wherein the embossing agent is present at a concentration of 55 to 60 weight of the embossing composition.

5. The process of claim 1 wherein a colorant is incorporated in the embossing composition.

6. The process of claim 1 wherein the embossing agent is incorporated in a dye paste composition.

7. The process of claim 1 wherein the embossed effect is made in register with a printed color design on said nylon pile fabric.

8. The process of claim 1 wherein the embossing action is effected in a steam environment.

9. The process of claim 1 wherein the embossing composition is first applied to the pile fiber.

10. A nylon pile fabric characterized by its embossed texture, the embossed areas being of fibers shrunk in situ in the portion of their length below the surface of the fabric.

* * * * *

UNITED STATES PATENT AND TRADEMARK OFFICE

CERTIFICATE OF CORRECTION

PATENT NO. : 4,443,505

DATED : April 17, 1984

INVENTOR(S) : Frank E. Ehrenfeld, Jr.

It is certified that error appears in the above-identified patent and that said Letters Patent is hereby corrected as shown below:

The term of this patent subsequent to July 20, 1999, has been disclaimed.

Signed and Sealed this

*Sixteenth* Day of *October 1984*

[SEAL]

*Attest:*

GERALD J. MOSSINGHOFF

*Attesting Officer*

*Commissioner of Patents and Trademarks*